US011766717B2

(12) United States Patent
Hattanda

(10) Patent No.: US 11,766,717 B2
(45) Date of Patent: Sep. 26, 2023

(54) SLIDING GATE DEVICE

(71) Applicant: TYK CORPORATION, Minato-ku (JP)

(72) Inventor: Hirokatsu Hattanda, Tajimi (JP)

(73) Assignee: TYK CORPORATION, Minato-ku (JP)

( * ) Notice: Subject to any disclaimer, the term of this patent is extended or adjusted under 35 U.S.C. 154(b) by 63 days.

(21) Appl. No.: 17/291,773

(22) PCT Filed: Nov. 7, 2018

(86) PCT No.: PCT/JP2018/041350

§ 371 (c)(1),
(2) Date: May 6, 2021

(87) PCT Pub. No.: WO2020/095384

PCT Pub. Date: May 14, 2020

(65) Prior Publication Data

US 2022/0008989 A1 Jan. 13, 2022

(51) Int. Cl.

| | |
|---|---|
| ***B22D 41/24*** | (2006.01) |
| ***B22D 41/34*** | (2006.01) |
| ***B22D 41/38*** | (2006.01) |
| ***B22D 41/40*** | (2006.01) |

(52) U.S. Cl.

CPC ..... *B22D 41/24* (2013.01); *B22D 41/34* (2013.01); *B22D 41/38* (2013.01); *B22D 41/40* (2013.01)

(58) Field of Classification Search

CPC ..... B22D 41/24; B22D 41/34; B22D 41/38; B22D 41/40

See application file for complete search history.

(56) References Cited

U.S. PATENT DOCUMENTS

2022/0008989 A1* 1/2022 Hattanda ..... B22D 41/38

FOREIGN PATENT DOCUMENTS

| | | | |
|---|---|---|---|
| JP | 2010-234426 | A | 10/2010 |
| JP | 2011-212702 | A | 10/2011 |
| JP | 6711521 | B2 | 6/2020 |

(Continued)

OTHER PUBLICATIONS

International Search Report dated Feb. 5, 2019 in PCT/JP2018/041350 filed on Nov. 7, 2018, 1 page.

(Continued)

*Primary Examiner* — Scott R Kastler
(74) *Attorney, Agent, or Firm* — Oblon, McClelland, Maier & Neustadt, L.L.P.

(57) ABSTRACT

A sliding gate device includes a fixed plate fixed to a molten steel container, a sliding plate for opening/closing a nozzle hole, a sliding device moving a case holding the sliding plate, and a contact pressure control mechanism switching between a contact pressure applied state and a no-contact-pressure applied state for the fixed plate and the sliding plate. The contact pressure control mechanism has a support bar member moving relative to the fixed plate, a joining block tool switching between a joined state where the support bar member and the case cooperate with each other, and a joining-released state where the support bar member and the case do not cooperate with each other, and a spring member generating a force applying a contact pressure according to a position of the support bar member.

6 Claims, 9 Drawing Sheets

(56) References Cited

FOREIGN PATENT DOCUMENTS

| | | | |
|---|---|---|---|
| WO | WO 2010/095638 | A1 | 8/2010 |
| WO | WO 2017/217083 | A1 | 12/2017 |
| WO | WO 2019/008929 | A1 | 1/2019 |

OTHER PUBLICATIONS

Extended European Search report dated May 24, 2022 in European Patent Application No. 18939617.9, 9 pages.
Notification of Reasons for Refusal dated Sep. 27, 2022 in Japanese Patent Application No. 2020-556405 (with English machine translation), 8 pages.

* cited by examiner

SLIDING GATE DEVICE

TECHNICAL FIELD

The present invention relates to a sliding gate device that performs switching between a state where a contact pressure is applied between a fixed plate and a sliding plate, and a state where application of the contact pressure is released.

BACKGROUND ART

To date, a sliding gate device disposed at a tap hole in the bottom of a molten steel container has been known (for example, see Patent Literature 1). The sliding gate device includes a fixed plate and a sliding plate. Each of the fixed plate and the sliding plate has a through hole through which molten steel in the molten steel container flows. While applying a contact pressure between the fixed plate and the sliding plate, the sliding gate device moves both the plates relative to each other by sliding the sliding plate with use of a cylinder as a sliding device, thereby switching between communication and non-communication of the through holes of both the plates. By switching between the communication and non-communication of the through holes, a nozzle hole of an insert nozzle inserted in the tap hole of the molten steel container is opened and closed. Thus, a flow rate of the molten steel from the molten steel container is controlled.

The above-described sliding gate device includes a contact pressure control mechanism. The contact pressure control mechanism uses a cylinder to move forward and backward a contact pressure bar that receives a contact pressure from a spring, thereby applying a contact pressure between the fixed plate and the sliding plate from the spring, and releasing the application of the contact pressure. Specifically, in order to prevent leakage of the molten steel from between both the plates while the sliding gate device controls the flow rate of the molten steel, the contact pressure control mechanism moves the contact pressure bar backward with use of the cylinder to apply a contact pressure between both the plates. In order to replace the plate, the contact pressure bar is moved forward with use of the cylinder to release application of the contact pressure between both the plates.

In the above-described sliding gate device, by moving the contact pressure bar backward with use of the cylinder, an engagement portion of the contact pressure bar engages with a roller disposed in a spring case having the spring therein, to apply the contact pressure between the fixed plate and the sliding plate from the spring. Meanwhile, by moving the contact pressure bar forward with use of the cylinder, the engagement portion of the contact pressure bar disengages from the roller of the spring case, to release the application of the contact pressure from the spring as described above.

CITATION LIST

Patent Literature

Patent Literature 1: JP2011-212702 (A)

SUMMARY OF INVENTION

Technical Problem

In the sliding gate device in which the contact pressure bar is moved forward and backward with use of the cylinder in order to switch between the communication and non-communication of the through holes, and the contact pressure bar is moved forward with use of the cylinder in order to replace the plate as described above, a structure for preventing application of a contact pressure from being released while switching between the communication and non-communication of the slide plate is controlled is important. If the sliding gate device does not have such a structure, in a case where the contact pressure bar unintentionally moves forward while switching between the communication and non-communication of the slide plate is controlled, the engagement portion of the contact pressure bar is likely to disengage from the roller of the spring case to erroneously release application of the contact pressure between the fixed plate and the sliding plate from the spring while switching between the communication and non-communication of the slide plate is controlled.

The present invention has been made in order to solve the aforementioned problem, and an object of the present invention is to provide a sliding gate device that achieves, through sliding movement by one sliding device, control of switching between the communication and non-communication of the slide plate in a state where a contact pressure is applied between a fixed plate and a sliding plate and control of switching between application of the contact pressure and release of the application, and also assuredly avoids release of application of the contact pressure while switching between the communication and non-communication of the slide plate is controlled.

Solution to Problem

One aspect of the present invention is directed to a sliding gate device including: a fixed plate having a fixed-side through hole communicating with a nozzle hole of an insert nozzle through which molten steel in a molten steel container is poured, the fixed plate fixed to the molten steel container; a sliding plate having a sliding-side through hole that is allowed to communicate with the fixed-side through hole, the sliding plate configured to slidably move relative to the fixed plate in a predetermined direction, and open and close the nozzle hole by switching between communication and non-communication of the sliding-side through hole with the fixed-side through hole through sliding relative to the fixed plate; a sliding device configured to slide, in the predetermined direction, a slider case by which the sliding plate is detachably held; and a contact pressure control mechanism configured to switch between a contact pressure applied state in which a contact pressure is applied between the fixed plate and the sliding plate, and a no-contact-pressure applied state in which a contact pressure is not applied between the fixed plate and the sliding plate. The contact pressure control mechanism includes: a support bar member supported so as to move relative to the fixed plate in the predetermined direction; a joining block tool detachably mounted between the support bar member and the slider case, the joining block tool configured to switch between a joined state in which the support bar member and the slider case cooperate with each other by mounting the joining block tool, and a joining-released state in which the support bar member and the slider case do not cooperate with each other by dismounting the joining block tool; and a spring member configured to generate a force for applying a contact pressure between the fixed plate and the sliding plate in a case where the support bar member has been moved relative to the fixed plate in conjunction with the slider case so as to satisfy a predetermined relative-position relationship.

In this configuration, the contact pressure control mechanism switches between a contact pressure applied state in which a contact pressure is applied between the fixed plate and the sliding plate, and a no-contact-pressure applied state in which the contact pressure is not applied. The joining block tool of the contact pressure control mechanism is detachably mounted between the slider case and the support bar member supported so as to be movable relative to the fixed plate in the predetermined direction. By mounting the joining block tool, the support bar member and the slider case cooperate with each other (joined state). By dismounting the joining block, cooperation of the support bar member and the slider case with each other is released (joining-released state). In such a configuration, the support bar member is moved relative to the fixed plate in the predetermined direction in the joined state in which the support bar member and the slider case are joined to each other, and is fixed relative to the fixed plate in the joining-released state in which the support bar member and the slider case are not joined to each other. When the support bar member has been moved relative to the fixed plate in conjunction with the slider case so as to satisfy the predetermined relative-position relationship, a contact pressure is applied between the fixed plate and the sliding plate from the spring member. Therefore, the control of switching between the communication and non-communication of the slide plate, and control of switching between application of a contact pressure and release of the application are achieved through sliding movement by one sliding device in a simplified configuration. Furthermore, during control of switching between the communication and non-communication of the slide plate, as long as the joining block tool is left dismounted, the support bar member does not cooperate with the slider case, and is prevented from being in a state where the predetermined relative-position relationship with respect to the fixed plate is not satisfied. Therefore, application of a contact pressure is assuredly prevented from being released during control of switching between the communication and non-communication of the slide plate.

DESCRIPTION OF EMBODIMENTS

A specific embodiment of a sliding gate device according to the present invention will be described below with reference to the drawings.

Figure 1:
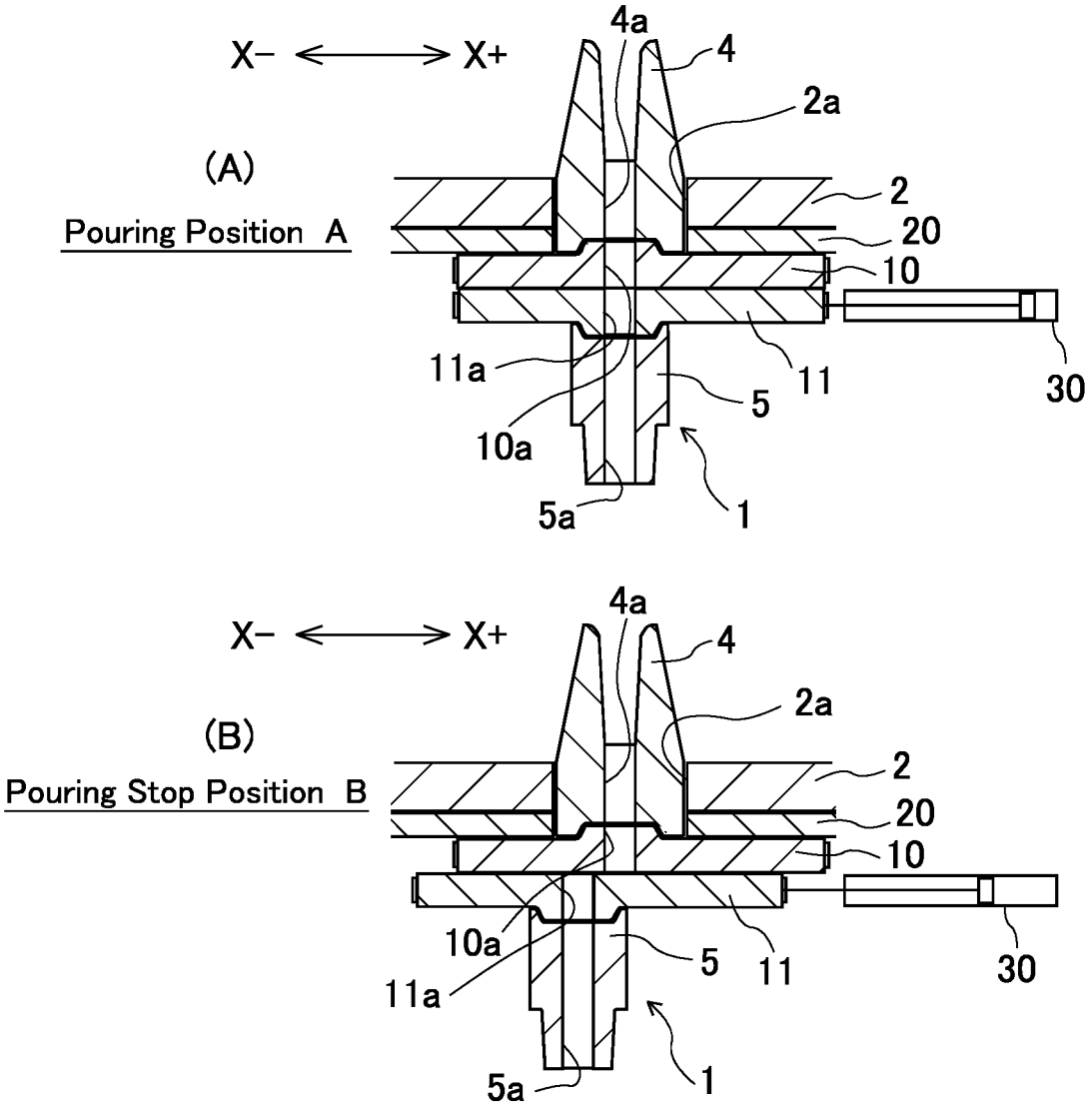
FIG. 1 illustrates disposition of a sliding gate device according to one embodiment at a pouring position A ((A) of FIG. 1) and a pouring stop position B ((B) of FIG. 1)

A sliding gate device 1 according to one embodiment is a device mounted to a molten steel container 2 such as a ladle or a tundish, as shown in FIG. 1. The molten steel container 2 is, for example, a container formed by an iron plate for containing molten steel as high-temperature molten metal for casing. Brick as a refractory material is arranged inside a container of the molten steel container 2.

A through hole 2*a* is formed in the bottom of the molten steel container 2. An insert nozzle 4 is mounted and fixed to the bottom of the molten steel container 2 so as to penetrate through the through hole 2*a*. The insert nozzle 4 has a penetrating nozzle hole 4*a*. The insert nozzle 4 is a pouring nozzle by which molten steel contained in the molten steel container 2 flows out and is poured through the nozzle hole 4*a*. The insert nozzle 4 is a member formed of a highly refractory material (for example, alumina or carbon) for allowing continuous casting.

The sliding gate device 1 is disposed so as to correspond to the insert nozzle 4. The sliding gate device 1 includes a fixed plate 10, a sliding plate 11, a mounting plate 20, a sliding device 30, and a bottom plate 40. The sliding gate device 1 causes the sliding device 30 to slide the sliding plate 11 relative to the fixed plate 10, to control communication and non-communication of the through holes, and thus opens and closes the nozzle hole 4*a* of the insert nozzle 4 to control flowing-out of molten steel from the insert nozzle 4.

Each of the fixed plate 10 and the sliding plate 11 is a plate-shaped brick member. The fixed plate 10 and the sliding plate 11 are stacked in the up-down direction. Specifically, the fixed plate 10 is disposed on the bottom side of the molten steel container 2, and the sliding plate 11 is disposed below and adjacent to the fixed plate 10. The sliding plate 11 is slidable relative to the fixed plate 10 in a predetermined direction X (hereinafter, referred to as sliding direction X) along the opposing surface of the fixed plate 10. The sliding plate 11 slides in the sliding direction X to open and close the nozzle hole 4*a* of the insert nozzle 4.

The fixed plate 10 is a plate-like member that is fixed to the molten steel container 2 through the mounting plate 20. The fixed plate 10 is detachably mounted to and held by the mounting plate 20, and eventually, the molten steel container 2. The fixed plate 10 has a through hole 10*a* through which molten steel flows. The through hole 10*a* is formed for pouring the molten steel contained in the molten steel container 2 into an external mold or the like. The through hole 10*a* has an inner diameter that is almost equal to an inner diameter of the nozzle hole 4*a* of the insert nozzle 4. The fixed plate 10 is fixed to the molten steel container 2 so as to satisfy such a positional relationship that the through hole 10*a* communicates with the nozzle hole 4*a* of the insert nozzle 4. The fixed plate 10 is allowed to have a cushion member or a tin plate as a buffer member mounted on a surface that comes into contact with the mounting plate 20.

Figure 2:
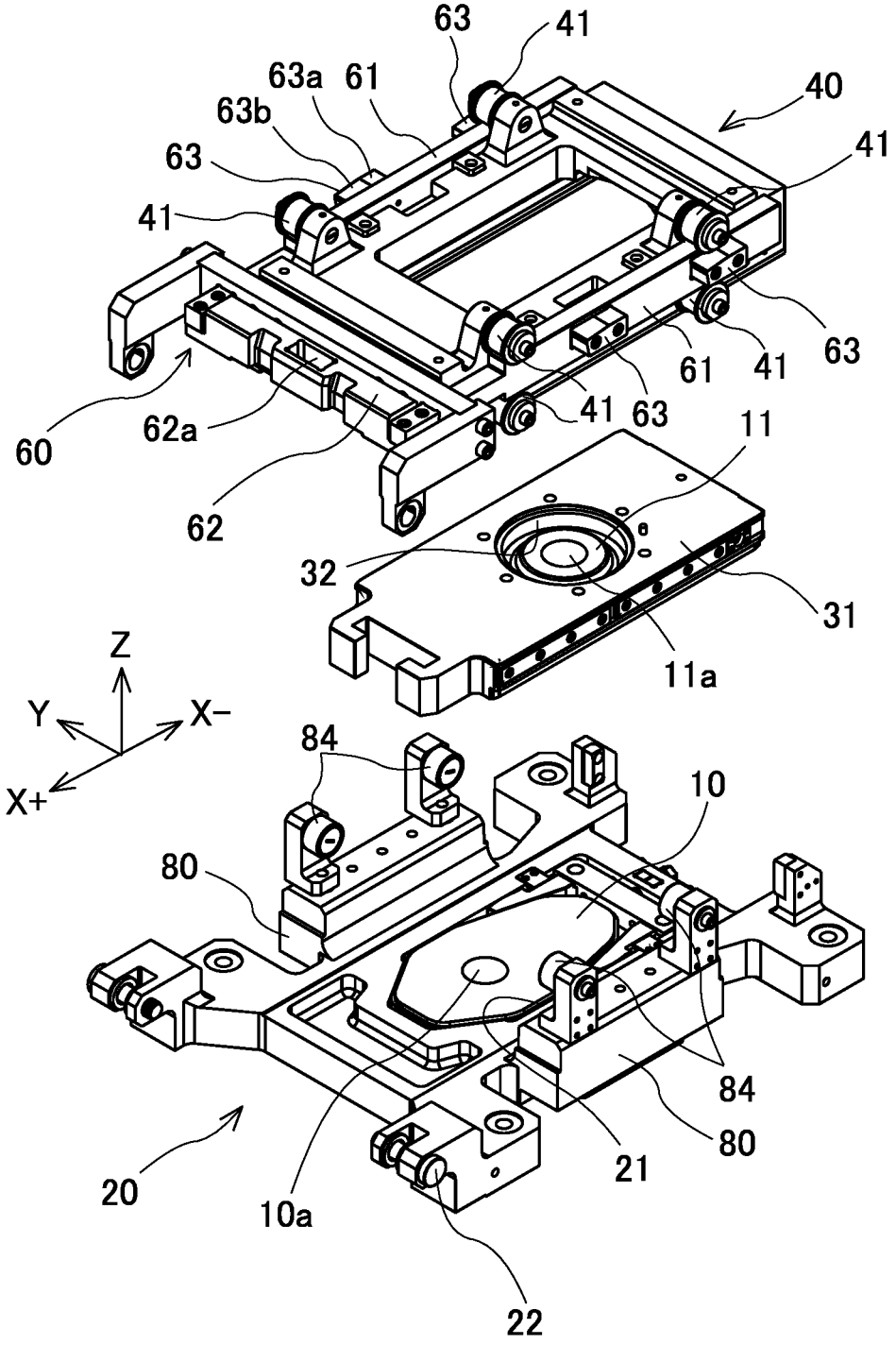
FIG. 2 is an exploded view of a contact pressure control mechanism of the sliding gate device according to the embodiment.

The mounting plate 20 is plate-shaped as shown in FIG. 2. The mounting plate 20 is mounted and fixed to the molten steel container 2. The mounting plate 20 is mounted to the molten steel container 2 by using bolts and brackets. The mounting plate 20 has a recessed groove 21 in which the fixed plate 10 is stored. The mounting plate 20 stores and holds the fixed plate 10 in the recessed groove 21 in a state where the through hole 10*a* penetrates.

The sliding plate 11 is a plate-like member that is slidable relative to the fixed plate 10, and eventually, the molten steel container 2 in the sliding direction X. The sliding plate 11 is detachably mounted to and held by a slider case 31 of the sliding device 30. The sliding plate 11 has a through hole 11*a* through which molten steel flows. The through hole 11*a* is formed for pouring the molten steel contained in the molten steel container 2 into an external mold or the like. The through hole 11*a* has an inner diameter that is almost equal to the inner diameter of each of the nozzle hole 4*a* of the insert nozzle 4 and the through hole 10*a* of the fixed plate 10.

A pouring nozzle 5 is mounted and fixed to the sliding plate 11. The pouring nozzle 5 is disposed on the back surface of the sliding plate 11 on the side opposite to the surface side opposing the fixed plate 10. The pouring nozzle 5 is a member formed of a highly refractory material (for example, alumina or carbon) for allowing continuous casting. The pouring nozzle 5 has a nozzle hole 5*a* through which the molten steel flows. The nozzle hole 5*a* has an inner diameter that is almost equal to the inner diameter of the nozzle hole 4*a* of the insert nozzle 4 or the like. The pouring nozzle 5 is fixed to the sliding plate 11 so as to satisfy such a positional relationship that the nozzle hole 5*a* communicates with the through hole 11*a* of the sliding plate 11.

The sliding device 30 is a device for sliding the sliding plate 11 relative to the fixed plate 10, and eventually, relative to the molten steel container 2. The sliding device 30 slides the sliding plate 11 by using a drive source such as an oil-hydraulic cylinder or a motor. The sliding device 30 linearly slides the sliding plate 11 in the sliding direction X while sliding the sliding plate 11 along the opposing surface of the fixed plate 10.

The sliding device 30 has the slider case 31 in which the sliding plate 11 is detachably mounted and held. The slider case 31 is box-shaped. The slider case 31 has a recessed groove 32 in which the sliding plate 11 is stored. The slider case 31 stores and holds the sliding plate 11 in the recessed groove 32 in a state where the through hole 11*a* penetrates.

Figure 3:
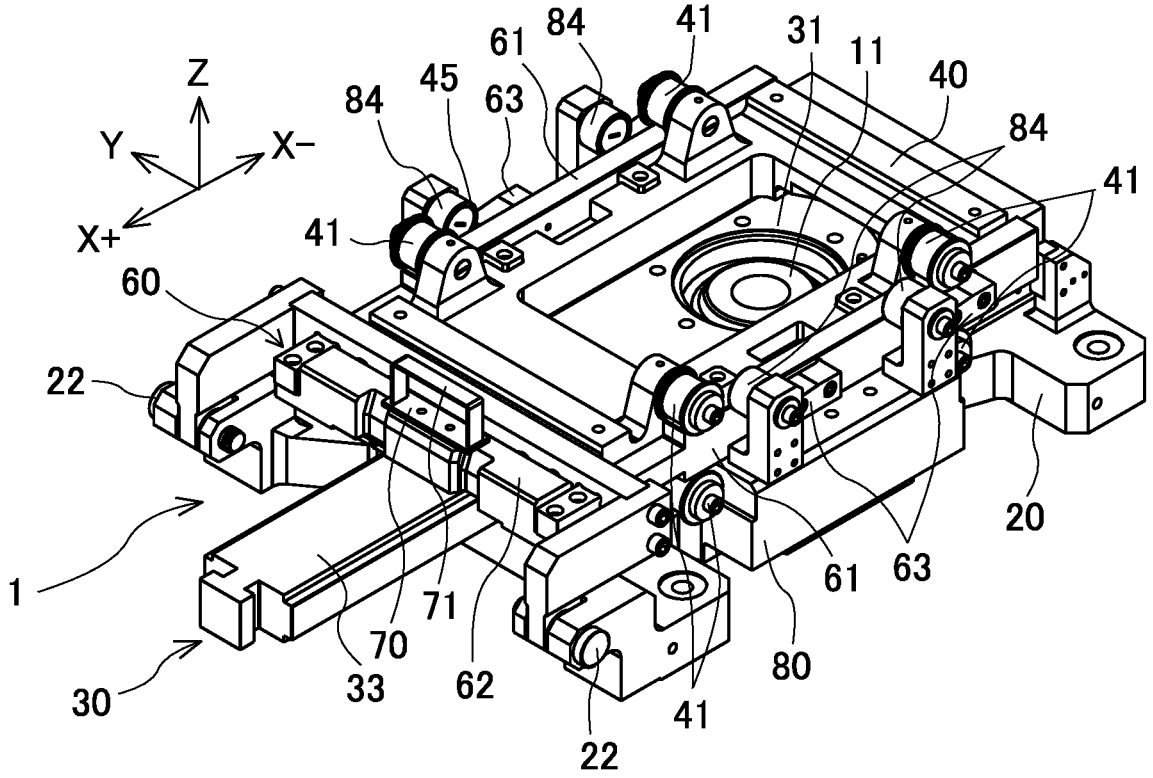
FIG. 3 is a perspective view of the sliding gate device (in a no-contact-pressure applied state in which application of a contact pressure is released) according to the embodiment.
Figure 4:
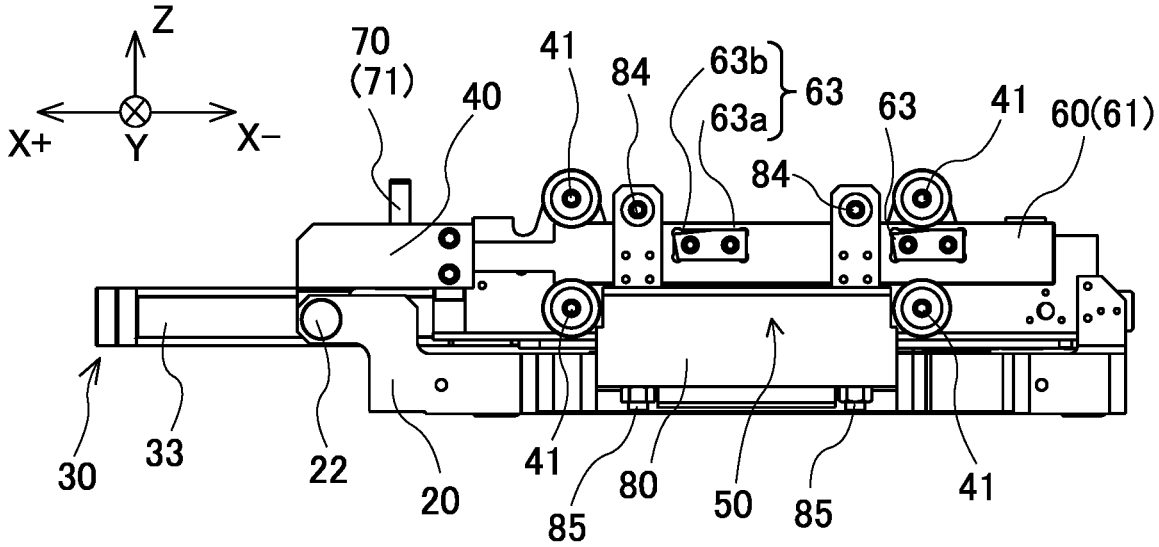
FIG. 4 is a side view of the sliding gate device (in the no-contact-pressure applied state in which application of a contact pressure is released) according to the embodiment.
Figure 5:
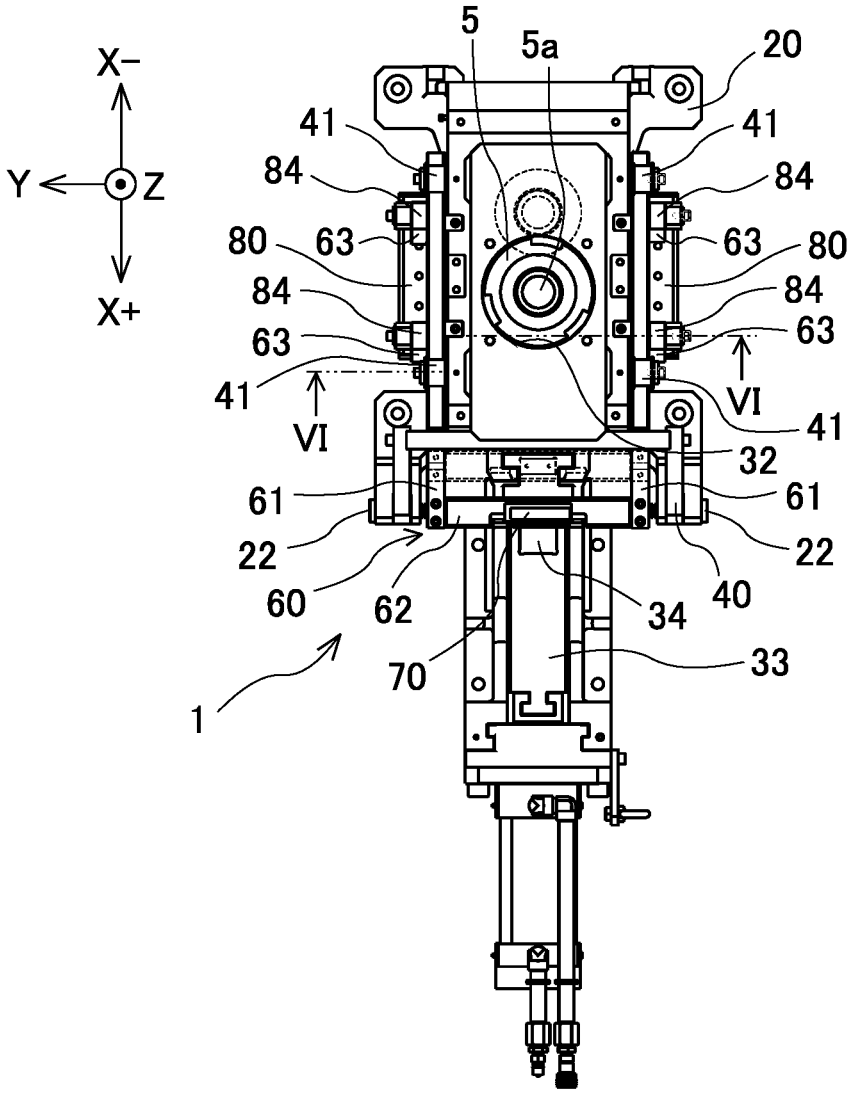
FIG. 5 is a top view of the sliding gate device according to the embodiment (a contact pressure applied state in which a contact pressure is applied is indicated by solid lines and the no-contact-pressure applied state in which application of a contact pressure is released is indicated by broken lines)

The slider case 31 is joined to the drive source (not shown) via a cylinder joint 33. The cylinder joint 33 is a quadrangular-bar-shaped member extending in the sliding direction X, as shown in FIG. 3, FIG. 4, and FIG. 5. The cylinder joint 33 joins the drive source and the slider case 31 to each other. The above-described drive source allows the slider case 31 to reciprocate in the sliding direction X through the cylinder joint 33. The slider case 31 is slidable relative to the mounting plate 20 and the bottom plate 40 in the sliding direction X. The sliding device 30 moves the slider case 31 relative to the mounting plate 20 and the bottom plate 40 in the sliding direction X to slide the sliding plate 11 held by the slider case 31 in the sliding direction X while sliding the sliding plate 11 relative to the fixed plate 10.

The sliding device 30 slides the sliding plate 11 between a position (hereinafter, referred to as pouring position A) at which the through hole 11*a* communicates with the through hole 10*a* of the fixed plate 10 as shown in (A) of FIG. 1, and a position (hereinafter, referred to as pouring stop position B) at which the through hole 11*a* does not communicate with the through hole 10*a* as shown in (B) of FIG. 1. Hereinafter, the sliding direction X in which the sliding plate 11 slides from the pouring stop position B to the pouring position A is referred to as a sliding direction X+, and the opposite sliding direction X is referred to as a sliding direction X−.

The bottom plate 40 is substantially plate-shaped or frame-shaped. The bottom plate 40 is disposed on the side opposite to the molten steel container 2 side relative to the mounting plate 20. The bottom plate 40 is configured to hold the slider case 31 between the bottom plate 40 and the mounting plate 20. The bottom plate 40 is pivotally supported by the mounting plate 20.

The bottom plate 40 is pivotable, on one side in the sliding direction X, about an axis extending along one edge orthogonal to the sliding direction X. The bottom plate 40 pivots about a hinge pin 22 relative to the mounting plate 20. The hinge pin 22 extends in a direction (hereinafter, referred to as width direction Y) orthogonal to the sliding direction X and parallel to the plate surface of the mounting plate 20. This pivoting is allowed in a state where application of a contact pressure between the fixed plate 10 and the sliding plate 11 is released by a contact pressure control mechanism 50 described below, and is prohibited in a state where the contact pressure is applied.

The bottom plate 40 pivots between a position (so-called closed position) at which the bottom plate 40 is held so as to be parallel to the mounting plate 20, and a position (so-called opened position) at which the bottom plate 40 is held so as to be substantially perpendicular to the mounting plate 20. In a case where the bottom plate 40 is at the closed position, the sliding plate 11 is prevented from being taken out from the slider case 31. In a case where the bottom plate 40 is at the opened position, the sliding plate 11 is allowed to be taken out from the slider case 31.

Next, a normal operation for pouring control by the sliding gate device 1 according to the present embodiment will be described.

According to a request for casting an article, the sliding device 30 slides the sliding plate 11 to the pouring position A in order to cause molten steel to flow out from the molten steel container 2 containing the molten steel. At this pouring position A, the through hole 11*a* of the sliding plate 11 communicates with the through hole 10*a* of the fixed plate 10 and the nozzle hole 4*a* of the insert nozzle 4 inserted in the through hole 2*a* of the molten steel container 2. In this case, the nozzle hole 4*a* is opened, and, therefore, the molten steel contained in the molten steel container 2 flows out and is poured from the nozzle hole 4*a* of the insert nozzle 4 then through the through hole 10*a* of the fixed plate 10, the through hole 11*a* of the sliding plate 11, and the nozzle hole 5*a* of the pouring nozzle 5. Accordingly, the sliding device 30 allows the through hole 11*a* of the sliding plate 11 to communicate with the through hole 10*a* of the fixed plate 10, and eventually, with the nozzle hole 4*a* of the insert nozzle 4, so that the molten steel in the molten steel container 2 flows out and is cast.

According to a request for stopping the above-described casting, the sliding device 30 slides the sliding plate 11 from the pouring position A to the pouring stop position B. At the pouring stop position B, the through hole 11*a* of the sliding plate 11 does not communicate with the through hole 10*a* of the fixed plate 10. In this case, the nozzle hole 4*a* of the insert nozzle 4 is closed, whereby flowing-out of the molten steel contained in the molten steel container 2 is stopped and casting is stopped.

Next, the contact pressure control mechanism of the sliding gate device 1 according to the present embodiment will be described.

The sliding gate device 1 of the present embodiment includes the contact pressure control mechanism 50. The contact pressure control mechanism 50 is a mechanism for applying a contact pressure between the fixed plate 10 and the sliding plate 11, and releasing the application of the contact pressure. A magnitude of the contact pressure applied between the fixed plate 10 and the sliding plate 11 by the contact pressure control mechanism 50 is set so as to allow the sliding plate 11 to move relative to the fixed plate 10 while preventing leakage of molten steel from between both the plates 10 and 11.

The contact pressure control mechanism 50 presses the slider case 31 from the bottom plate 40 side toward the mounting plate 20, to apply a contact pressure between the fixed plate 10 and the sliding plate 11. The contact pressure control mechanism 50 has a support bar member 60, a joining block tool 70, and a spring box 80.

The support bar member 60 is supported by the bottom plate 40 so as to be movable in the sliding direction X. The support bar member 60 enters one of a state (hereinafter, referred to as a joined state) where the support bar member 60 is joined to the slider case 31 to integrally slide in conjunction with the slider case 31 when the slider case 31 moves in the sliding direction X, or a state (hereinafter, referred to as joining-released state) where joining of the support bar member 60 to the slider case 31 is released and, thus, the support bar member 60 does not cooperate with the slider case 31 to prevent the support bar member 60 from integrally sliding with the slider case 31. The support bar member 60 has a cam bar 61 and a direct bar 62.

The cam bar 61 is a quadrangular-bar-shaped or band-shaped member extending in the sliding direction X. The cam bar 61 extends along the side surface extending at the bottom plate 40 in the sliding direction X. The cam bar 61 is disposed so as to correspond to each of the side surfaces of the bottom plate 40 on both sides in the width direction Y. A cam portion 63 is disposed on the side surface of each of the cam bars 61. The cam portion 63 is a block-shaped portion for generating a force for applying a contact pressure between the fixed plate 10 and the sliding plate 11.

The cam portion 63 is wedge-shaped. The cam portion 63 has a horizontal surface 63*a* parallel to the sliding direction X, and a tilted surface 63*b* tilted relative to the sliding direction X. The horizontal surface 63*a* and the tilted surface 63*b* are formed in the cam portion 63 on the surface on the side opposite to the mounting plate 20 side, among two surfaces in the direction (hereinafter, referred to as the up-down direction Z) orthogonal to both the sliding direction X and the width direction Y.

The tilted surface 63*b* is disposed on such a side that an engagement portion 84 described below comes into contact with the tilted surface 63*b* earlier than with the horizontal surface 63*a* in a case where the sliding plate 11 slides from the pouring stop position B toward the pouring position A in the sliding direction X+. The tilted surface 63*b* is tilted relative to the sliding direction X at, for example, 5° to 10° (preferably, 6°). The horizontal surface 63*a* and the tilted surface 63*b* are formed so as to be continuous with each other in the sliding direction X. The cam portion 63 is detachably and replaceably mounted to the side surface of the cam bar 61. The cam portion 63 is mounted to the cam bar 61 by, for example, using bolts.

The bottom plate 40 has rollers 41. The rollers 41 are rotatably supported by a body portion of the bottom plate 40. The rollers 41 are disposed on both sides of the bottom plate 40 in the width direction Y so as to correspond to the two cam bars 61. On one side of the bottom plate 40 in the width direction Y, the paired two rollers 41 are spaced from each other over a thickness of the cam bar 61 in the up-down direction Z, and two pairs of the paired two rollers 41 are spaced from each other over a predetermined distance in the sliding direction X.

The roller 41 is rotated about a supporting axis extending in the width direction Y relative to the side surface of the bottom plate 40. The cam bar 61 described above is inserted between the paired rollers 41 spaced from each other in the up-down direction Z, and is inserted in each of the rollers 41 in the two pairs spaced from each other in the sliding direction X, whereby the cam bars 61 are guided so as to be moved in the sliding direction X by the rollers 41.

The direct bar 62 is a quadrangular-bar-shaped member extending in the width direction Y. The direct bar 62 joins the two cam bars 61 to each other. The direct bar 62 moves integrally with the two cam bars 61 in the sliding direction X. The direct bar 62 has a fit-insertion hole 62*a* that penetrates in the up-down direction Z. The fit-insertion hole 62*a* is shaped so as to fit to the outer shape of the joining block tool 70. The joining block tool 70 is fit-inserted into the fit-insertion hole 62*a*.

Figure 13:
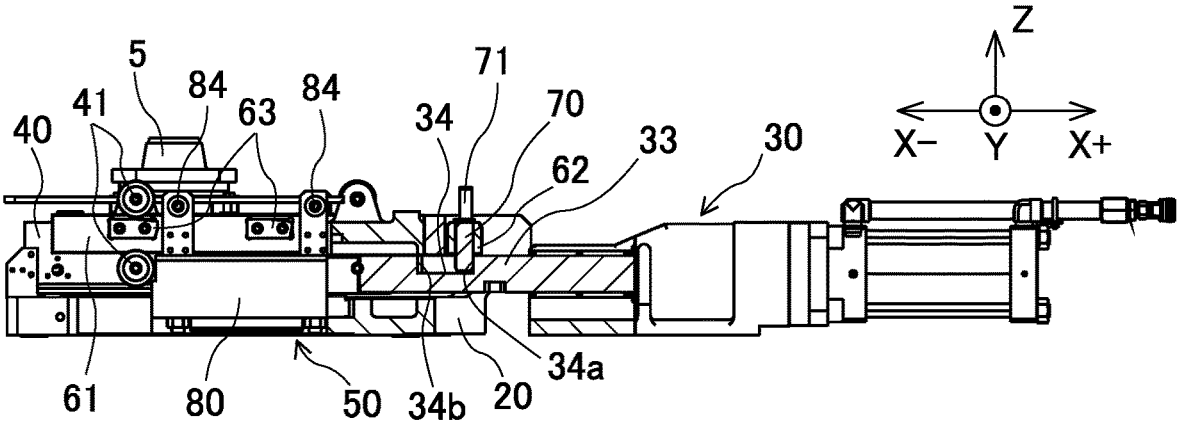
FIG. 13 is a side view (a part of FIG. 13 is a cross-sectional view) of the sliding gate device in the no-contact-pressure applied state, according to the embodiment.
Figure 14:
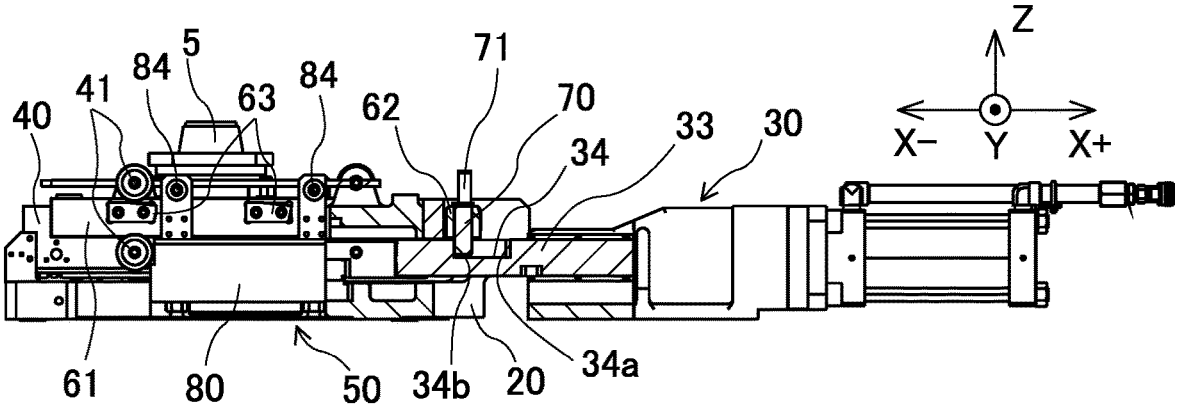
FIG. 14 is a side view (a part of FIG. 14 is a cross-sectional view) of the sliding gate device shifting from the no-contact-pressure applied state to the contact pressure applied state, according to the embodiment.
Figure 15:
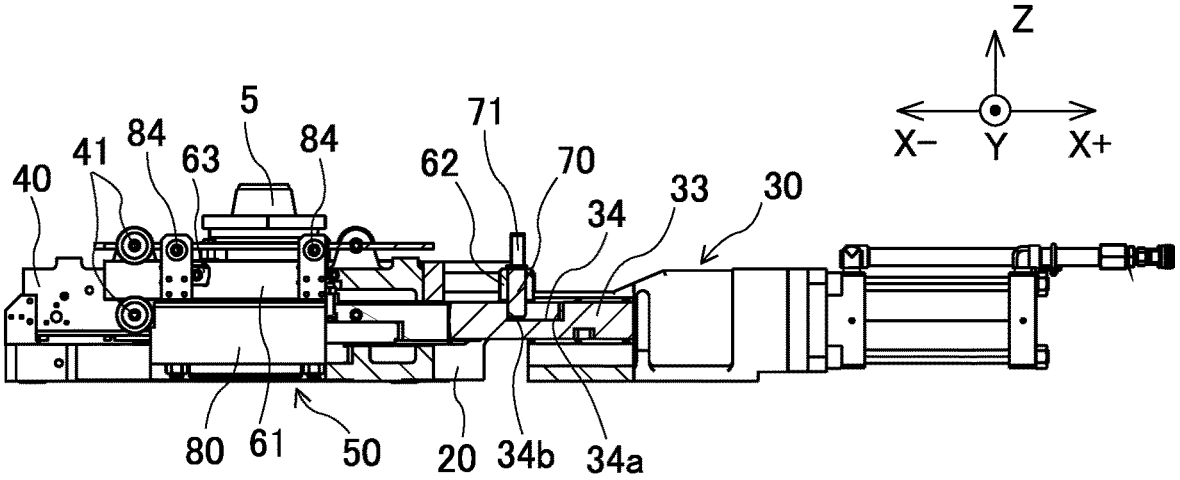
FIG. 15 is a side view (a part of FIG. 15 is a cross-sectional view) of the sliding gate device in the contact pressure applied state, according to the embodiment.

The cylinder joint 33 has a recessed groove 34 that is recessed in a surface opposing the direct bar 62 on the side opposite to the mounting plate 20 side, among two surfaces in the up-down direction Z. The recessed groove 34 is a groove in which the leading end of the joining block tool 70 that has been fit-inserted in the fit-insertion hole 62*a* of the direct bar 62 is fitted. The recessed groove 34 has a groove width that coincides with the width of the leading end of the joining block tool 70 in the width direction Y, and has a groove length greater than the width of the leading end of the joining block tool 70 in the sliding direction X. That is, the recessed groove 34 is formed in a long-hole-like shape extending in the sliding direction X. The recessed groove 34 is surrounded by four peripheral edge portions each standing in the vertical direction in the cylinder joint 33. The joining block tool 70 is spaced from at least one of peripheral edge portions 34*a* and 34*b* in the sliding directions X+ and X− through a gap when the leading end has been fitted in the recessed groove 34, as shown in FIG. 13 to FIG. 15.

Figure 11:
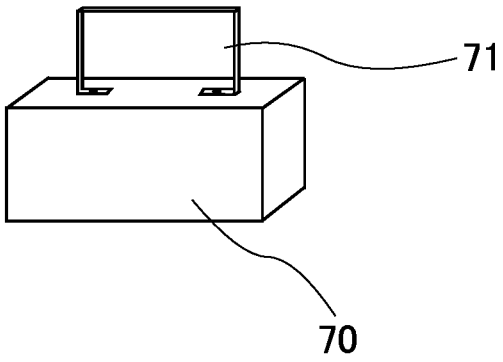
FIG. 11 is a perspective view of a joining block tool of the contact pressure control mechanism according to the embodiment.
Figure 12:
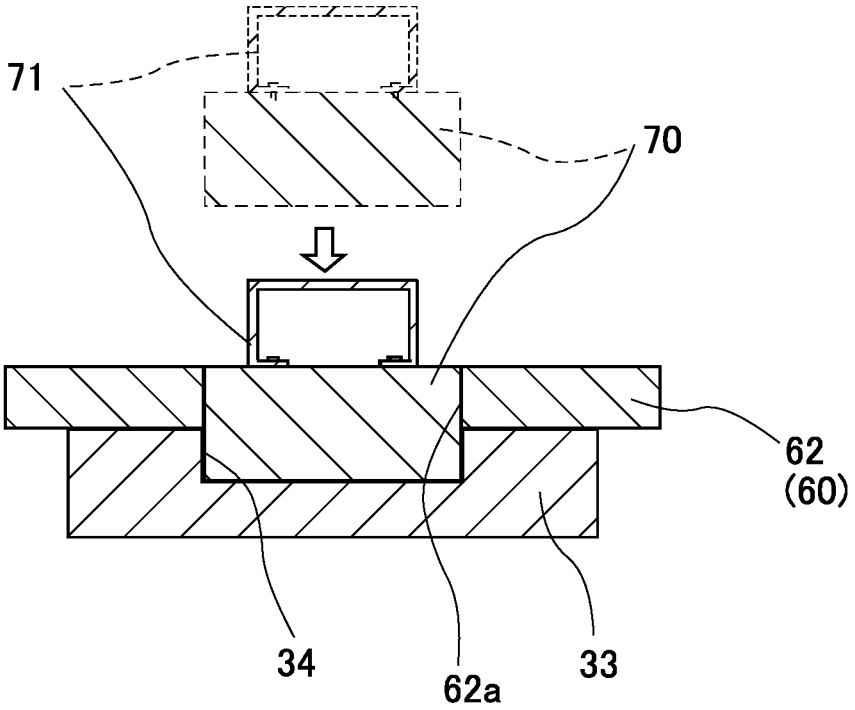
FIG. 12 is a cross-sectional view illustrating a state in which the joining block tool joins a support bar member and a cylinder joint to each other, according to the embodiment.

The joining block tool 70 is a tool for switching between the joined state in which the support bar member 60 and the slider case 31 are joined to each other and the joining-released state. The joining block tool 70 is block-shaped so as to be fit-inserted into the fit-insertion hole 62*a* of the direct bar 62 and be fitted in the recessed groove 34 of the cylinder joint 33, as shown in FIG. 11 and FIG. 12. The joining block tool 70 has a handle 71 for allowing an operator to carry the joining block tool 70. The joining block tool 70 is mounted between the support bar member 60 (specifically, the direct bar 62) and the slider case 31 (specifically, the cylinder joint 33). The joining block tool 70 is detachably mounted to the direct bar 62 and the cylinder joint 33.

Figure 7:
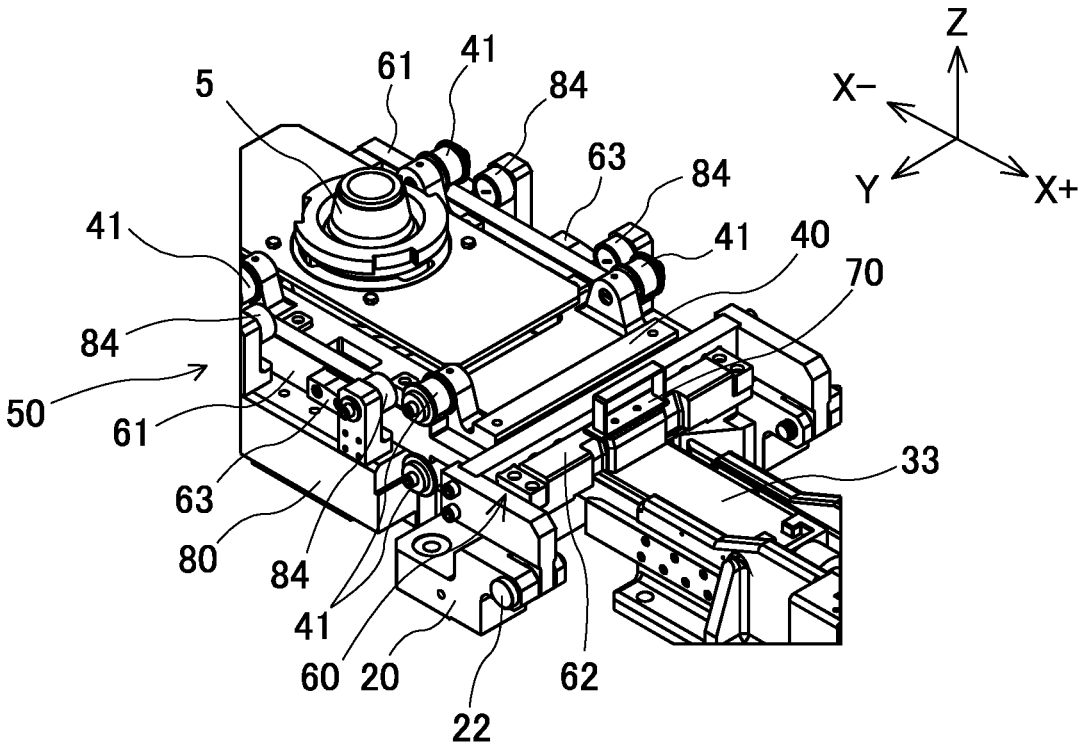
FIG. 7 is a perspective view of the sliding gate device in the no-contact-pressure applied state, according to the embodiment.
Figure 8:
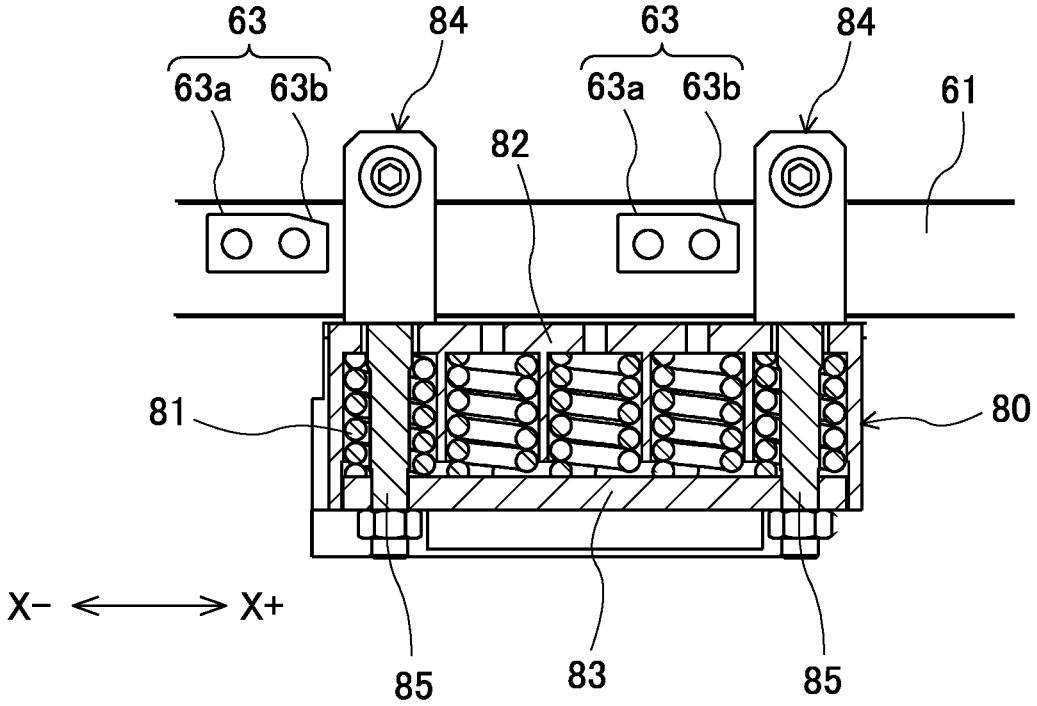
FIG. 8 is a cross-sectional view illustrating a state of a spring box of the contact pressure control mechanism of the sliding gate device in the no-contact-pressure applied state, according to the embodiment.
Figure 9:
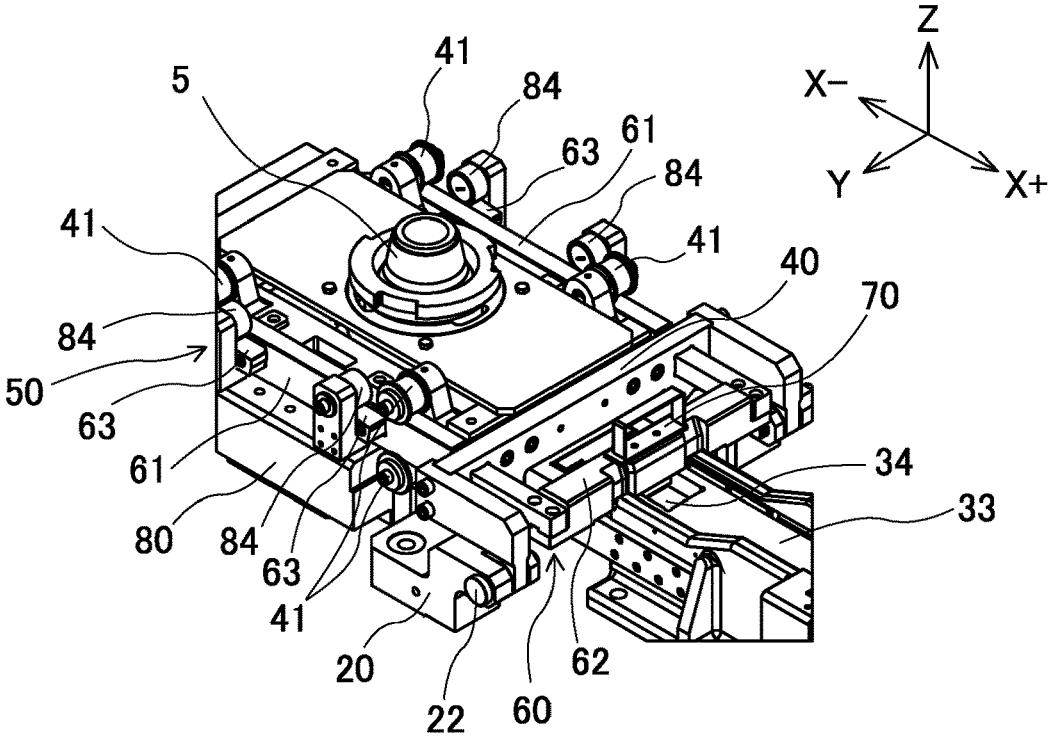
FIG. 9 is a perspective view of the sliding gate device in the contact pressure applied state, according to the embodiment.
Figure 10:
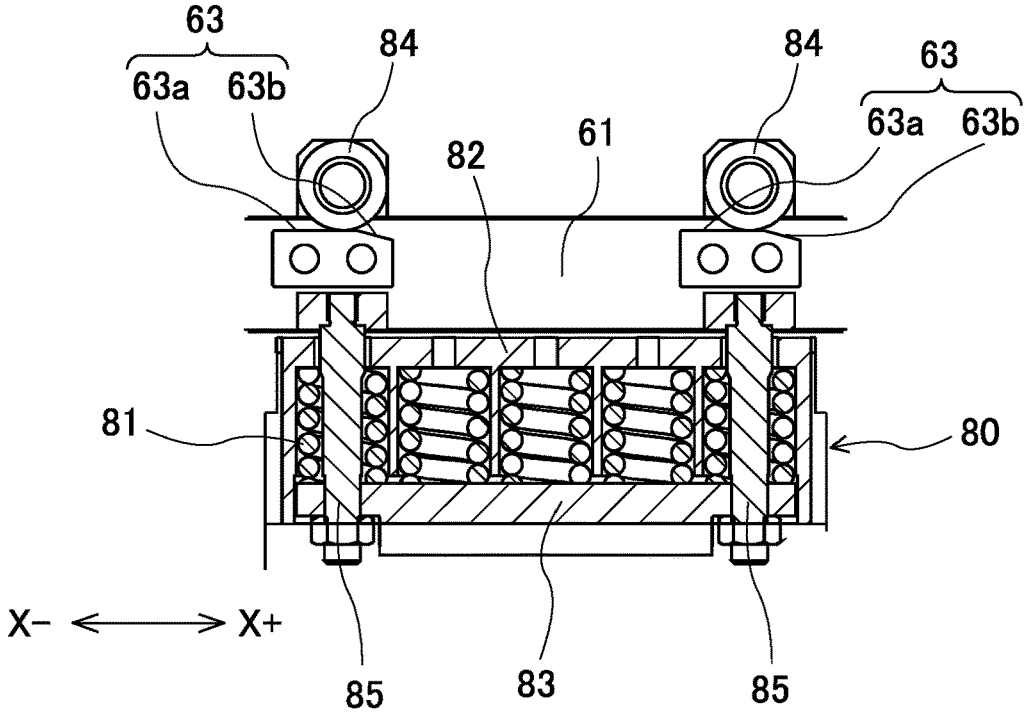
FIG. 10 is a cross-sectional view illustrating a state of the spring box of the contact pressure control mechanism of the sliding gate device in the contact pressure applied state, according to the embodiment.

In a case where the joining block tool 70 is mounted between the support bar member 60 and the slider case 31, the contact pressure control mechanism 50 is allowed to apply a contact pressure between the fixed plate 10 and the sliding plate 11 while in the no-contact-pressure applied state (state shown in FIG. 7 and FIG. 8) in which no contact pressure is applied, and also release application of the contact pressure while in the contact pressure applied state (state shown in FIG. 9 and FIG. 10).

When the slider case 31 is moved in the sliding direction X, the joining block tool 70 enters one of a state where the joining block tool 70 is brought into contact with one of the peripheral edge portions 34*a* and 34*b* of the cylinder joint 33 and pressed in the sliding direction X, or a state where the joining block tool 70 is brought into contact with the peripheral edge portions 34*a* and 34*b* and is not pressed in the sliding direction X. In a case where the joining block tool 70 is pressed by either one of the peripheral edge portions 34*a* and 34*b* of the cylinder joint 33, the support bar member 60 and the slider case 31 are joined to each other, whereby the support bar member 60 and the slider case 31 integrally slide in conjunction with each other. In a state where the joining block tool 70 is not pressed by either one of the peripheral edge portions 34*a* and 34*b* of the cylinder joint 33, joining of the support bar member 60 and the slider case 31 to each other is released, whereby the support bar member 60 and the slider case 31 do not cooperate with each other, and integral sliding of the support bar member 60 and the slider case 31 is prevented.

The spring box 80 is a box-shaped member in which a spring 81 is stored. The spring box 80 is disposed so as to correspond to each of the side surfaces on both sides of the bottom plate 40 in the width direction Y. Each spring box 80 stores a plurality (for example, five as shown in FIG. 8) of the springs 81 aligned in parallel. The spring 81 is a spring member (elastic member) that generates a spring force for applying a contact pressure between the fixed plate 10 and the sliding plate 11. The spring 81 generates the spring force in the up-down direction Z. The plurality of the springs 81 are aligned in parallel with each other in the spring box 80, and generate a predetermined spring force required for applying a predetermined contact pressure.

Figure 6:
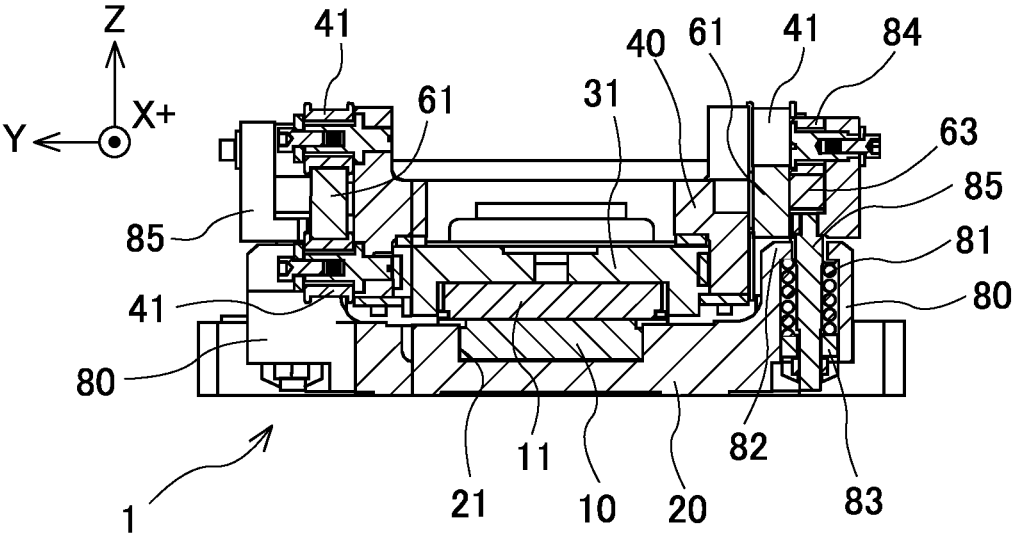
FIG. 6 is a cross-sectional view of the sliding gate device, taken along a line VI-VI in FIG. 5, according to the embodiment.

The spring box 80 has a fixed portion 82 to which one end of each spring 81 is fixed, and a plate-shaped movable portion 83 to which the other end of the spring 81 is fixed, as shown in FIG. 6, FIG. 8, and FIG. 10. The fixed portion 82 is fixed to the mounting plate 20 or integrated with the mounting plate 20. The movable portion 83 is allowed to be displaced relative to the fixed portion 82 in the up-down direction Z in which the spring 81 is extended and contracted. A spring force generated by the spring 81 is applied between the fixed portion 82 and the movable portion 83.

The movable portion 83 has the engagement portion 84. The engagement portion 84 is joined to the movable portion 83 via a bar 85. One bar 85 is disposed at each of both ends of the spring box 80 in the sliding direction X. The bar 85 is a substantially bar-shaped member extending in the up-down direction Z. The bar 85 passes through the center of the spring 81 located at the end position in the sliding direction X, and penetrates through the fixed portion 82. The bar 85 is fastened to the movable portion 83 at one end side and is joined to the engagement portion 84 at the other end side opposite to the one end side.

The engagement portion 84 is a round rotary body (roller) rotatably supported at the other end side of the bar 85. The engagement portion 84 is allowed to be displaced integrally with the movable portion 83 in the up-down direction Z. Two engagement portions 84 are disposed so as to be spaced from each other over a predetermined distance in the sliding direction X so as to correspond to the cam portions 63, on each of both sides of the bottom plate 40 in the width direction Y. Each of the engagement portions 84 is disposed so as to come into contact with the cam portion 63 while the sliding plate 11 slides from the pouring stop position B toward the pouring position A in the sliding direction X+. The engagement portion 84 rotates about a supporting axis extending in the width direction Y on the side surface of the bottom plate 40.

The engagement portion 84 comes into contact and engagement with the cam portion 63 of the cam bar 61. Engagement and disengagement between the engagement portion 84 and the cam portion 63 change according to a position of the support bar member 60 relative to the mounting plate 20, that is, relative to the fixed plate 10 in the sliding direction X as described below in detail. The engagement portion 84 comes into contact with the tilted surface 63*b* and engages with the horizontal surface 63*a*, at the inner end (lower end shown in FIG. 10 or the like) of the engagement portion 84.

In a case where the engagement portion 84 does not come into contact with the tilted surface 63*b* of the cam portion 63, and does not engage with the horizontal surface 63*a*, the spring 81 is in a neutral state, and a force transmitted from the spring 81 to the cam portion 63 for pressing the cam portion 63 downward is almost zero. Therefore, a force for allowing the support bar member 60 to press the bottom plate 40 toward the mounting plate 20 is not generated, and a force for holding the slider case 31 between the bottom plate 40 and the mounting plate 20 does not act. Therefore, a contact pressure applied between the fixed plate 10 and the sliding plate 11 by the contact pressure control mechanism 50 is almost zero.

When the engagement portion 84 comes into contact with the tilted surface 63*b* by sliding of the sliding plate 11, the movable portion 83 in the spring box 80 is thereafter displaced relative to the fixed portion 82 during the sliding, the spring 81 in the neutral state is contracted, and a force transmitted from the spring 81 to the cam portion 63 for pressing the cam portion 63 downward is gradually increased. Therefore, a force for allowing the support bar member 60 to press the bottom plate 40 toward the mounting plate 20 is generated and a force for holding the slider case 31 between the bottom plate 40 and the mounting plate 20 acts. Therefore, a contact pressure applied between the fixed plate 10 and the sliding plate 11 by the contact pressure control mechanism 50 is gradually increased.

In a case where the engagement portion 84 comes into contact and engagement with the horizontal surface 63*a*, contraction of the spring 81 is maximized, and the contact pressure applied between the fixed plate 10 and the sliding plate 11 by the contact pressure control mechanism 50 is maximized.

Next, an operation of the contact pressure control mechanism 50 of the sliding gate device 1 according to the present embodiment will be described.

The sliding gate device 1 is assembled such that the engagement portion 84 in the mounting plate 20 does not come into contact with the cam portion 63 of the support bar member 60 that is movably supported by the bottom plate 40. In this assembly, a contact pressure is not applied between the fixed plate 10 and the sliding plate 11 by the contact pressure control mechanism 50, and application of the contact pressure is released. At this time, the fit-insertion hole 62*a* of the support bar member 60 and the recessed groove 34 of the cylinder joint 33 communicate with each other in the up-down direction Z.

In a case where the fit-insertion hole 62*a* and the recessed groove 34 communicate with each other in the up-down direction Z as described above (specifically, in a state where the molten steel container 2 has been further tilted and rotated, that is, in a state where the mounting plate 20 is located on the depth side and the bottom plate 40 is located on the front side), the joining block tool 70 is allowed to be fit-inserted/inserted into the fit-insertion hole 62*a* and the recessed groove 34. In a case where the joining block tool 70 is fit-inserted into the fit-insertion hole 62*a* of the support bar member 60, and inserted into the recessed groove 34 of the cylinder joint 33, the support bar member 60 and the slider case 31 are allowed to slide in conjunction with each other. A stroke position of the sliding plate 11 at which the joining block tool 70 is in contact with the peripheral edge portion 34*a* of the cylinder joint 33 as shown in FIG. 13 is set as a reference position 0.

After the above-described assembly, in a case where application of a contact pressure between the fixed plate 10 and the sliding plate 11 is required, an operator manually fit-inserts the joining block tool 70 into the fit-insertion hole 62*a* of the support bar member 60 and inserts the joining block tool 70 in the recessed groove 34 of the cylinder joint 33, and, thereafter, the sliding device 30 slides the slider case 31, and eventually, the sliding plate 11 in the sliding direction X+. In a case where a gap is present between the peripheral edge portion 34*b* and the joining block tool 70 inserted in the recessed groove 34, the joining block tool 70 moves in the recessed groove 34 of the cylinder joint 33 at the initial stage of sliding in the sliding direction X+, and, thus, the support bar member 60 and the slider case 31 are not joined to each other, to prevent integral sliding of the support bar member 60 and the slider case 31 (joining-released state).

In a case where, as shown in FIG. 14, the joining block tool 70 has come into contact with the peripheral edge portion 34*b* of the cylinder joint 33 (for example, the stroke position of the sliding plate 11=80 mm), the peripheral edge portion 34*b* thereafter presses the joining block tool 70 in the sliding direction X+. Therefore, the support bar member 60 and the slider case 31 are joined to each other, and the support bar member 60 and the slider case 31 integrally slide in conjunction with each other (joined state). While the support bar member 60 slides integrally with the slider case 31, the cam portion 63 of the support bar member 60 comes into contact and engagement with the engagement portion 84 in the mounting plate 20. By this engagement, a force for pressing the bottom plate 40 toward the mounting plate 20 is applied from the spring 81 to the support bar member 60, and a contact pressure is applied between the fixed plate 10 and the sliding plate 11.

At the initial stage of engagement of the cam portion 63 and the engagement portion 84 with each other, the engagement portion 84 is in contact with the tilted surface 63*b* of the cam portion 63. In this case, a force applied from the spring 81 to the support bar member 60 for pressing the bottom plate 40 toward the mounting plate 20 is low, and a contact pressure applied between the fixed plate 10 and the sliding plate 11 is low. As engagement of the cam portion 63 and the engagement portion 84 with each other progresses, the engagement portion 84 comes into contact with the horizontal surface 63*a* of the cam portion 63 (for example, the stroke position of the sliding plate 11=200 mm), as shown in FIG. 15. In this case, the force applied from the spring 81 to the support bar member 60 for pressing the bottom plate 40 toward the mounting plate 20 is maximized, and a contact pressure applied between the fixed plate 10 and the sliding plate 11 is maximized. At this time, communication between the fit-insertion hole 62*a* of the support bar member 60 and the recessed groove 34 of the cylinder joint 33 is maintained.

In a case where application of the contact pressure between the fixed plate 10 and the sliding plate 11 as described above has been completed, the joining block tool 70 is taken out from the recessed groove 34 of the cylinder joint 33 and the fit-insertion hole 62*a* of the support bar member 60, and the molten steel container 2 is erected such that the mounting plate 20 is located on the upper side and the bottom plate 40 is located on the lower side. Casting is performed by using the molten steel container 2, and, during the casting, the sliding plate 11 slides between the pouring position A and the pouring stop position B.

During the above-described casting, the joining block tool 70 is not disposed between the support bar member 60 and the cylinder joint 33. Therefore, the support bar member 60 does not move relative to the bottom plate 40, that is, relative to the mounting plate 20. Therefore, the cam portion 63 of the support bar member 60 and the engagement portion 84 in the mounting plate 20 are not disengaged from each other, and application of the contact pressure between the fixed plate 10 and the sliding plate 11 is thus maintained.

Next, for example, according to a request for replacing the sliding plate 11 or the fixed plate 10, or a request for maintenance of the sliding gate device 1, firstly, an operator manually fit-inserts the joining block tool 70 into the fit-insertion hole 62*a* of the support bar member 60 and inserts the joining block tool 70 in the recessed groove 34 of the cylinder joint 33 in a state where the molten steel container 2 has been tilted and rotated such that the mounting plate 20 is located on the depth side and the bottom plate 40 is located on the front side.

Thereafter, the sliding device 30 slides the slider case 31, and eventually, the sliding plate 11 in the sliding direction X−. At the initial stage of sliding in the sliding direction X−, a gap is present between the joining block tool 70 and the peripheral edge portion 34*a* of the recessed groove 34 of the cylinder joint 33, and the joining block tool 70 moves in the recessed groove 34. Therefore, the support bar member 60 and the slider case 31 are not joined to each other, and integral sliding of the support bar member 60 and the slider case 31 is prevented (joining-released state).

In a case where the joining block tool 70 has come into contact with the peripheral edge portion 34*a* of the cylinder joint 33, the peripheral edge portion 34*a* thereafter presses the joining block tool 70 in the sliding direction X−.

Therefore, the support bar member 60 and the slider case 31 are joined to each other, and the support bar member 60 and the slider case 31 integrally slide in conjunction with each other (joined state). The integral sliding of the support bar member 60 and the slider case 31 disengages the cam portion 63 of the support bar member 60 and the engagement portion 84 in the mounting plate 20 from each other. Then, a force for pressing the bottom plate 40 toward the mounting plate 20 is no longer applied from the spring 81 to the support bar member 60, and application of the contact pressure between the fixed plate 10 and the sliding plate 11 is released.

When the application of the contact pressure between the fixed plate 10 and the sliding plate 11 has been released as described above, the joining block tool 70 is taken out from the recessed groove 34 of the cylinder joint 33 and the fit-insertion hole 62*a* of the support bar member 60, and the bottom plate 40 is allowed to pivot relative to the mounting plate 20. An operator manually pivots the bottom plate 40, so that the bottom plate 40 is in the opened position, and the bottom plate 40 and the mounting plate 20 are greatly separated from each other. Therefore, the sliding plate 11 held by the slider case 31 or the fixed plate 10 held by the mounting plate 20 is allowed to be detached or attached, so that the plate 10, 11 is replaced.

After the plate 10, 11 has been replaced as described above, a contact pressure is applied between the fixed plate 10 and the sliding plate 11 in a procedure reverse to the above-described procedure. Specifically, after the plate 10, 11 has been replaced, the bottom plate 40 is pivoted relative to the mounting plate 20 from the opened position toward the closed position, and the joining block tool 70 is mounted between the support bar member 60 and the cylinder joint 33. Thereafter, the support bar member 60 and the sliding plate 11 are slid in conjunction with each other by the contact pressure control mechanism 50, and a contact pressure is applied between the fixed plate 10 and the sliding plate 11.

Thus, in the sliding gate device 1 according to the present embodiment, in a case where the sliding device 30 slides the slider case 31 in the sliding direction X+ in a state where the joining block tool 70 is disposed between the support bar member 60 and the cylinder joint 33, a contact pressure is applied between the fixed plate 10 and the sliding plate 11 by the contact pressure control mechanism 50. Meanwhile, in a case where the sliding device 30 slides the slider case 31 in the sliding direction X− in a state where the joining block tool 70 is disposed between the support bar member 60 and the cylinder joint 33, application of a contact pressure as described above is released by the contact pressure control mechanism 50.

In a case where application of a contact pressure between the fixed plate 10 and the sliding plate 11 by the contact pressure control mechanism 50 has been completed, and the joining block tool 70 has been taken out from between the support bar member 60 and the cylinder joint 33, application of the contact pressure between the fixed plate 10 and the sliding plate 11 is maintained also when the sliding device 30 slides the slider case 31 between the pouring position A and the pouring stop position B, thereby switching between communication and non-communication of the through holes 10*a*, 11*a* of both the plates 10, 11, and controlling opening and closing of the nozzle hole 4*a* of the insert nozzle 4 of the molten steel container 2.

Therefore, switching between communication and non-communication of the through holes 10*a*, 11*a* of both the plates 10, 11 (that is control of opening and closing the nozzle hole 4*a* of the insert nozzle 4) in a state where the contact pressure is applied between the fixed plate 10 and the sliding plate 11, and control of switching between application of the contact pressure and release of the application are performed by sliding the slider case 31 in the sliding direction X with use of one sliding device 30, and are achieved through sliding movement by one sliding device 30. Therefore, the entire configuration is simplified for achieving both switching between communication and non-communication (that is the nozzle opening and closing control) and control of switching between application of a contact pressure and release of the application as described above.

The joining block tool 70 needs to be disposed between the direct bar 62 of the support bar member 60 and the cylinder joint 33 of the sliding device 30 in order to allow the contact pressure control mechanism 50 to shift the no-contact-pressure applied state to the contact pressure applied state. That is, in a case where the sliding device 30 slides the sliding plate 11 in the sliding direction X+ in a state where the joining block tool 70 is disposed between the direct bar 62 and the cylinder joint 33, the joining block tool 70 is pressed by the peripheral edge portion 34*b* of the cylinder joint 33 in the sliding direction X+, and the support bar member 60 and the cylinder joint 33 slide in conjunction with each other and thus reach a position at which the cam portion 63 of the support bar member 60 engages with the engagement portion 84 in the mounting plate 20. By engagement of the cam portion 63 and the engagement portion 84 with each other, a force for pressing the bottom plate 40 toward the mounting plate 20 is applied from the spring 81 to the support bar member 60, and a contact pressure is applied between the fixed plate 10 and the sliding plate 11.

Furthermore, the joining block tool 70 needs to be disposed between the direct bar 62 of the support bar member 60 and the cylinder joint 33 of the sliding device 30 in order to allow the contact pressure control mechanism 50 to shift the contact pressure applied state to the no-contact-pressure applied state. That is, in a case where the sliding device 30 slides the sliding plate 11 in the sliding direction X− in a state where the joining block tool 70 is disposed between the direct bar 62 and the cylinder joint 33, the joining block tool 70 is pressed by the peripheral edge portion 34*a* of the cylinder joint 33 in the sliding direction X−, and the support bar member 60 and the cylinder joint 33 slide in conjunction with each other and thus reach a position at which the cam portion 63 of the support bar member 60 disengages from the engagement portion 84 in the mounting plate 20. By disengagement of the cam portion 63 and the engagement portion 84 from each other, a force for pressing the bottom plate 40 toward the mounting plate 20 is no longer applied from the spring 81 to the support bar member 60, and application of the contact pressure between the fixed plate 10 and the sliding plate 11 is released.

Thus, in order to switch between the contact pressure applied state and the no-contact-pressure applied state for a contact pressure between the fixed plate 10 and the sliding plate 11, linear movement of the cylinder joint 33 and the slider case 31 in the sliding direction X by the sliding device 30 is transmitted via the joining block tool 70 to the support bar member 60, and transformed to linear movement of the support bar member 60 in the sliding direction X. In such a configuration, a pressing force by the sliding device 30 is efficiently transmitted to the support bar member 60. Therefore, switching between the contact pressure applied state and the no-contact-pressure applied state is stabilized. Furthermore, a structure for transmitting a pressing force from the sliding device 30 to the support bar member 60 is simplified, thereby reducing the number of components and enhancing the strength of the components.

Moreover, during the nozzle opening and closing control in which a contact pressure is applied between the fixed plate 10 and the sliding plate 11, the joining block tool 70 is not disposed between the direct bar 62 and the cylinder joint 33. At this time, even if the sliding plate 11 slides in the sliding direction X, the support bar member 60 does not cooperate with the sliding plate 11, and does not move relative to the bottom plate 40 or the mounting plate 20. Therefore, engagement between the cam portion 63 of the support bar member 60 and the engagement portion 84 in the mounting plate 20 is maintained. In this case, a force applied from the spring 81 to the support bar member 60 for pressing the bottom plate 40 toward the mounting plate 20 is maintained. Therefore, application of a contact pressure between the fixed plate 10 and the sliding plate 11 is maintained, and release of the application of the contact pressure is avoided.

Therefore, since the joining block tool 70 is not disposed between the direct bar 62 and the cylinder joint 33 during switching between communication and non-communication of the through holes 10*a*, 11*a* of the fixed plate 10 and the sliding plate 11 in the molten steel container 2 (that is during control of opening and closing the nozzle hole 4*a* of the insert nozzle 4), the contact pressure control mechanism 50 is assuredly prevented from releasing the application of the contact pressure between the fixed plate 10 and the sliding plate 11 during the opening and closing control.

Thus, in the sliding gate device 1 according to the present embodiment, while switching between communication and non-communication of the through holes 10*a*, 11*a* of the fixed plate 10 and the sliding plate 11 (that is control of opening and closing the nozzle hole 4*a* of the insert nozzle 4) in the contact pressure applied state in which a contact pressure is applied between the fixed plate 10 and the sliding plate 11, and control of switching between application of the contact pressure and release of the application are achieved through sliding movement by one sliding device 30, release of application of the contact pressure during control of opening and closing the nozzle hole 4*a* is assuredly avoided.

In the sliding gate device 1, in order to allow the contact pressure control mechanism 50 to release application of a contact pressure in the contact pressure applied state in which the contact pressure is applied between the fixed plate 10 and the sliding plate 11, the joining block tool 70 needs to be disposed between the support bar member 60 and the cylinder joint 33, specifically, the joining block tool 70 needs to be fit-inserted into the fit-insertion hole 62*a* of the direct bar 62 and inserted in the recessed groove 34 of the cylinder joint 33. In order to allow the contact pressure control mechanism 50 to switch between the application of the contact pressure and release of the application, an operator is simply required to position the joining block tool 70 between the support bar member 60 and the cylinder joint 33 or take out the joining block tool 70 disposed between the support bar member 60 and the cylinder joint 33. For example, a contact pressure applying/releasing tool other than the joining block tool 70 having a block-like shape need not be mounted to the sliding gate device 1 for switching between the application of the contact pressure and release of the application. Therefore, for switching between application of a contact pressure between the fixed plate 10 and the sliding plate 11 and release of the application, cost and work load are reduced.

Furthermore, in order to apply a contact pressure between the fixed plate 10 and the sliding plate 11, the cam portion 63 of the support bar member 60 needs to be engaged with the engagement portion 84 in the mounting plate 20. In order to release the application of the contact pressure, the cam portion 63 and the engagement portion 84 need to be disengaged from each other. Regarding this, the cam portion 63 is a component that comes into contact or engagement with the engagement portion 84 and is worn with the elapse of time. The cam portion 63 is detachably and replaceably mounted to the cam bar 61 by using bolts or the like. Therefore, the cam portion 63 is easily detached from the cam bar 61 and replaced. Thus, in a case where the cam portion 63 has been worn, the entirety of the cam bar 61 or the entirety of the support bar member 60 need not be replaced.

In the above-described embodiment, the contact pressure control mechanism 50 has the block-shaped cam portion 63 that is disposed at the support bar member 60 supported by the bottom plate 40 so as to be movable in the sliding direction X, and the engagement portion 84 that is disposed as a round rotary body at the movable portion 83 of the spring box 80 fixed to the mounting plate 20. Application of a contact pressure is controlled according to whether or not the cam portion 63 and the engagement portion 84 engage with each other. However, the present invention is not limited thereto. A configuration in which the block-shaped cam portion is disposed at the movable portion 83 of the spring box 80 in the mounting plate 20, the engagement portion as a round rotary body is disposed at the support bar member 60 supported by the bottom plate 40, and application of a contact pressure is controlled according to whether or not the cam portion and the engagement portion engage with each other, is allowed to be used. Also in the configuration according to the modification, the same effect as in the above-described embodiment is obtained.

Furthermore, the contact pressure control mechanism 50 has the block-shaped cam portion 63 formed in a wedge-like shape having the horizontal surface 63*a* and the tilted surface 63*b*, and the engagement portion 84 formed as a round rotary body. However, the present invention is not limited thereto. The contact pressure control mechanism 50 is allowed to have an ellipsoidal or drop-shaped cam portion that rotates according to sliding, and a block-shaped engagement portion merely having a horizontal surface. Also in this modification, the cam portion is disposed at one of the support bar member 60 and the movable portion 83, and the engagement portion is disposed at the other of the support bar member 60 and the movable portion 83. Also in the configuration according to the modification, the same effect as in the above-described embodiment is obtained.

The present invention is not limited to the embodiments and modifications described above, and various modifications can be made without departing from the gist of the invention.

DESCRIPTION OF THE REFERENCE CHARACTERS

1 sliding gate device
2 molten steel container
2*a* through hole
4 insert nozzle
4*a* nozzle hole
10 fixed plate
10*a* through hole (fixed-side through hole)
11 sliding plate
11*a* through hole (sliding-side through hole)
20 mounting plate

30 sliding device
31 slider case
33 cylinder joint
34 recessed groove
40 bottom plate
41 roller
50 contact pressure control mechanism
60 support bar member
61 cam bar
62 direct bar
63 cam portion
63*a* horizontal surface
63*b* tilted surface
70 joining block tool
80 spring box
81 spring
82 fixed portion
83 movable portion
84 engagement portion

The invention claimed is:

1. A sliding gate device comprising:

a fixed plate having a fixed-side through hole communicating with a nozzle hole of an insert nozzle through which molten steel in a molten steel container is poured, the fixed plate fixed to the molten steel container;

a sliding plate having a sliding-side through hole that is allowed to communicate with the fixed-side through hole, the sliding plate configured to slidably move relative to the fixed plate in a predetermined direction, and open and close the nozzle hole by switching between communication and non-communication of the sliding-side through hole with the fixed-side through hole through sliding relative to the fixed plate;

a sliding device configured to slide, in the predetermined direction, a slider case by which the sliding plate is detachably held; and a contact pressure control mechanism configured to switch between a contact pressure applied state in which a contact pressure is applied between the fixed plate and the sliding plate, and a no-contact-pressure applied state in which a contact pressure is not applied between the fixed plate and the sliding plate, wherein the contact pressure control mechanism includes a support bar member supported so as to move relative to the fixed plate in the predetermined direction, a joining block tool detachably mounted between the support bar member and the slider case, the joining block tool configured to switch between a joined state in which the support bar member and the slider case cooperate with each other, and a joining-released state in which the support bar member and the slider case do not cooperate with each other, and a spring member configured to generate a force for applying a contact pressure between the fixed plate and the sliding plate in a case where the support bar member has been moved relative to the fixed plate in conjunction with the slider case so as to satisfy a predetermined relative-position relationship, the fixed plate is held by a mounting plate mounted and fixed to the molten steel container, the support bar member is movably supported by a bottom plate that is pivotally supported by the mounting plate, the support bar member includes a cam bar disposed so as to correspond to each of both side surfaces extending at the bottom plate in the predetermined direction, the cam bar extending along each of the side surfaces, and a direct bar extending in a direction orthogonal to the predetermined direction, the direct bar joining two of the cam bars to each other, the direct bar having a fit-insertion hole in which the joining block tool is fit-inserted, the slider case or a cylinder joint for joining the slider case and a drive source of the sliding device has a recessed groove in which a leading end of the joining block tool fits, the recessed groove extends in the predetermined direction so as to have a groove length greater than a width of the leading end of the joining block tool in the predetermined direction, in a case where the joining block tool is mounted between the support bar member and the slider case, when the slider case is moved in the predetermined direction, the joining block tool enters one of a joined state where the joining block tool is brought into contact with a peripheral edge portion of the recessed groove and is pressed thereby in the predetermined direction, or a joining-released state where the joining block tool is not brought into contact with the peripheral edge portion of the recessed groove and is not pressed thereby in the predetermined direction, and in the joined state where the joining block tool is pressed by the peripheral portion of the recessed groove in the predetermined direction, the support bar member and the slider case integrally slide in conjunction with each other and in the joining-released state where the joining block tool is not pressed by the peripheral edge portion of the recessed groove, the support bar member and the slider case do not cooperate with each other, and an integral sliding of the support bar member and the slider case is prevented.

2. The sliding gate device according to claim 1, wherein the contact pressure control mechanism includes a spring box having a fixed portion to which one end of the spring member is fixed, and a movable portion to which another end of the spring member is fixed, an engagement portion disposed at the movable portion, and a cam portion for causing the spring member to generate the force by engaging with the engagement portion, the spring box is mounted to the mounting plate, and the cam portion is disposed at the support bar member.

3. The sliding gate device according to claim 2, wherein the cam portion is replaceable by being detached from a body portion of the support bar member.

4. The sliding gate device according to claim 1, wherein the contact pressure control mechanism applies a contact pressure between the fixed plate and the sliding plate in a case where a first peripheral edge portion on one side of the recessed groove in the predetermined direction presses the joining block tool toward another side in the predetermined direction according to the slider case sliding from the one side to the other side in the predetermined direction to dispose the support bar member relative to the fixed plate such that the predetermined relative-position relationship is satisfied, and releases application of a contact pressure between the fixed plate and the sliding plate in a case where a second peripheral edge portion on the other side of the recessed groove in the predetermined direction presses the joining block tool toward the one side in the predetermined direction according to the slider case sliding from the other side to the one side in the predetermined direction to disengage the support bar member from the fixed plate such that the predetermined relative-position relationship is not satisfied.

5. The sliding gate device according to claim 4, wherein the contact pressure control mechanism includes a spring box having a fixed portion to which one end of the spring member is fixed, and a movable portion to which another end of the spring member is fixed, an engagement portion disposed at the movable portion, and a cam portion for causing the spring member to generate the force by engaging with the engagement portion, the spring box is mounted to the mounting plate, and the cam portion is disposed at the support bar member.

6. The sliding gate device according to claim 5, wherein the cam portion is replaceable by being detached from a body portion of the support bar member.

* * * * *